US005875905A

United States Patent [19]

Gretencord

[11] Patent Number: 5,875,905

[45] Date of Patent: Mar. 2, 1999

[54] TAPERED CANTILEVERED SUPPORT ARM FOR STORAGE RACK SYSTEMS

[75] Inventor: Timothy Arthur Gretencord, South Bend, Ind.

[73] Assignee: United Fixtures Company, Niles, Mich.

[21] Appl. No.: 873,045

[22] Filed: Jun. 11, 1997

[51] Int. Cl.[6] ..... A47F 5/00

[52] U.S. Cl. ..... 211/193; 211/183; 29/897.31; 29/897.35

[58] Field of Search ..... 211/193, 190, 211/183; 29/897.35, 897.31

[56] References Cited

U.S. PATENT DOCUMENTS

| | | | |
|---|---|---|---|
| 1,594,658 | 8/1926 | Bushong | 29/897.31 |
| 1,644,940 | 10/1927 | Moyer . | |
| 2,617,179 | 11/1952 | Burke | 29/897.35 |
| 2,937,766 | 5/1960 | Penn | 211/193 |
| 3,164,255 | 1/1965 | Jay | 211/193 X |
| 3,400,831 | 9/1968 | De Niet | 211/193 |

FOREIGN PATENT DOCUMENTS

| | | | |
|---|---|---|---|
| 7408320 | 12/1974 | Netherlands | 211/193 |

*Primary Examiner*—Robert W. Gibson, Jr.
*Attorney, Agent, or Firm*—Lee, Mann, Smith, McWilliams, Sweeney & Ohlson

[57] ABSTRACT

An elongated tapered arm for mounting to a storage rack vertical standard in a cantilevered fashion. An integral elongated structural member having an upper surface, a web-like lower surface joined to the upper surface which varies from a maximum height at the base end to a minimum height at the tip end. The structural member has parallel ends and has the general shape of an elongated trapezoid. A bottom plate is secured to the web and a mounting plate is secured to the wide end of the structural member and bottom plate. A tip end mounting plate is secured to the narrow end of the arm and is constructed to secure an upright thereto. A method for cutting an I-beam so as to produce two tapered structural members is also disclosed.

5 Claims, 1 Drawing Sheet

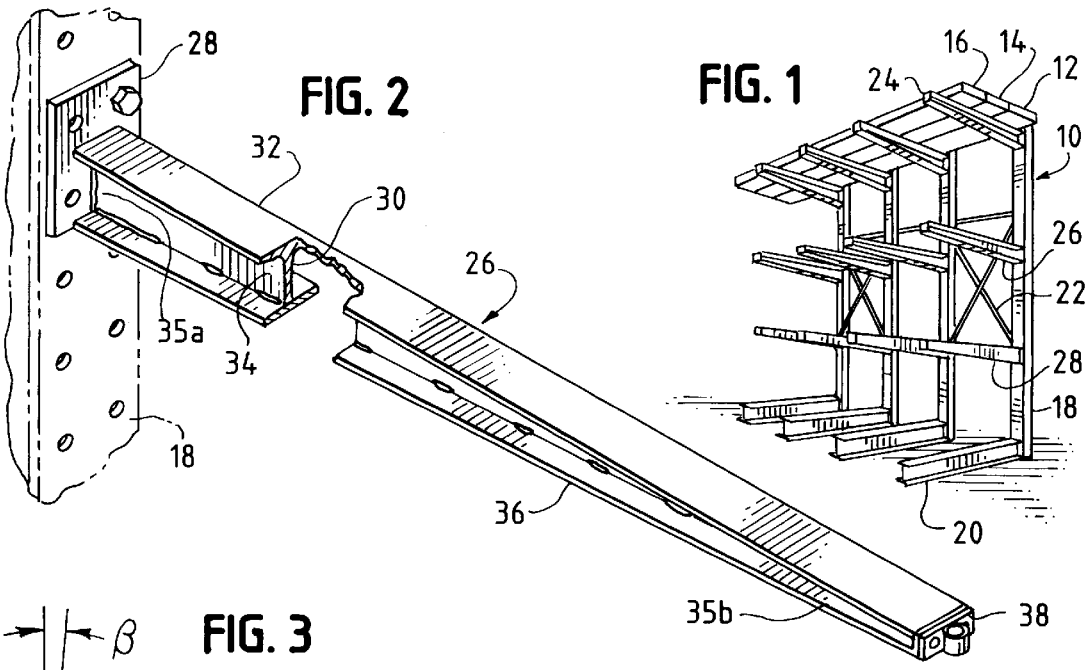
FIG. 2
28
32
30
26
35a
34
18
36
35b
38
FIG. 1
16
14
12
24
10
26
22
28
18
20
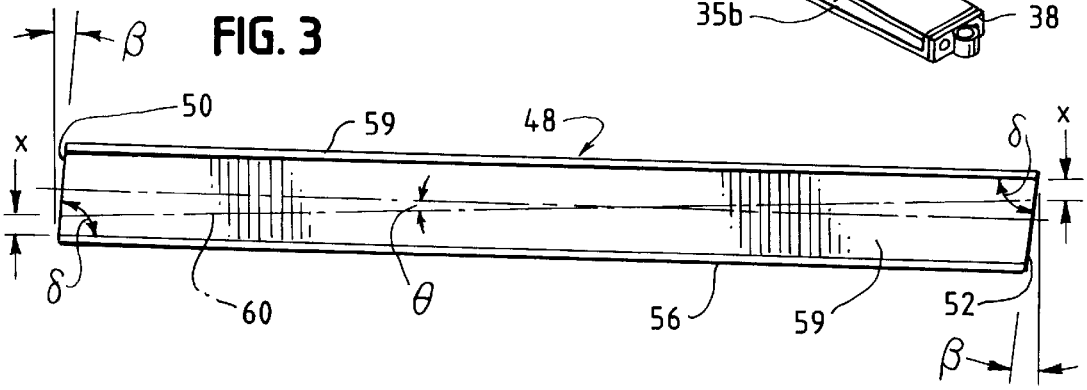
FIG. 3
β
50
59
48
x
δ
x
δ
60
θ
56
59
52
β
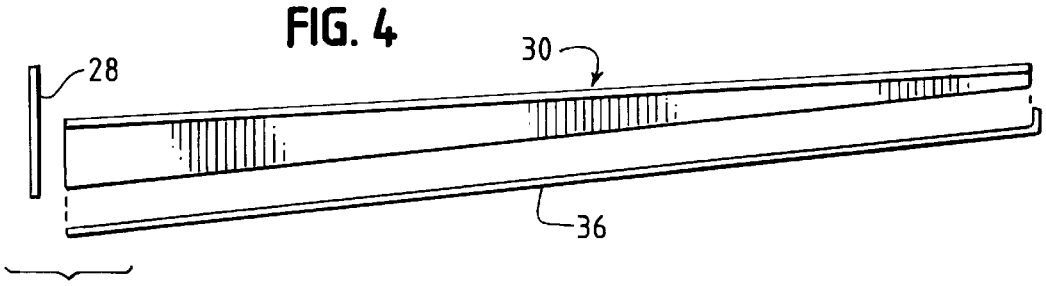
FIG. 4
28
30
36
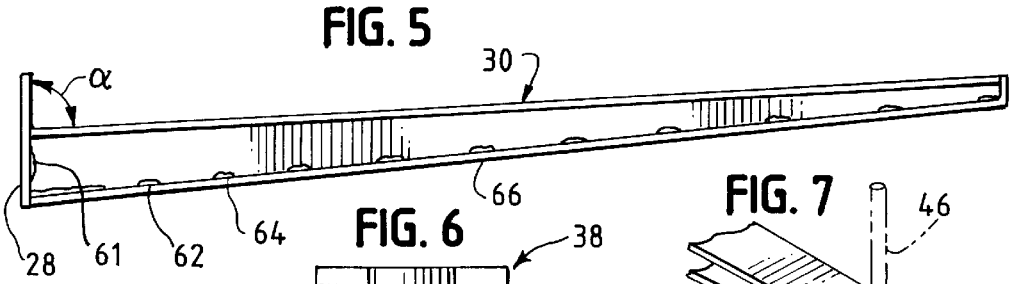
FIG. 5
α
30
66
28
61
62
64
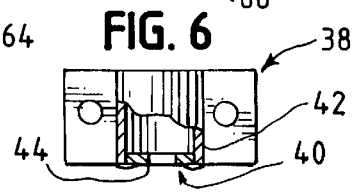
FIG. 6
38
42
44
40
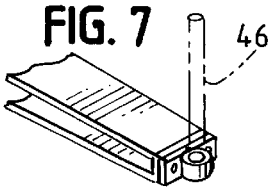
FIG. 7
46

TAPERED CANTILEVERED SUPPORT ARM FOR STORAGE RACK SYSTEMS

This invention relates to a cantilevered arm for securement to a vertical standard in a storage rack and more specifically to an angled and tapered cantilevered arm and method for making same.

Storage racks fabricated from structural steel are well known and used for the storage of many industrial items and the like. One type of system employs vertical standards to which cantilevered arms are attached at their inner or base end and which extend outwardly for supporting various types of items. Usually several vertical standards are held together with a cross-bracing system which includes diagonal and horizontal braces. The cantilevered arms extend from one or both sides of the vertical standards. Thus the system is either double-sided (arms on both sides) or single-sided (arms only on one side). These cantilever systems provide an advantage in that they do not require an upright at the outer tip or distal ends for support. Such an upright may interfere with storage. Thus where long unobstructed spaces are needed to store long articles such as, lumber, bar stock or rugs, the cantilever racks can be used. These systems exhibit a weight carrying capacity up to about twelve tons.

The cantilevered arms may be horizontal but in some situations are upwardly angled at a small angle, for example 4°, relative to the horizontal. This upward inclination maintains the arm in a supporting position even if the vertical standard or support column deflects under unbalanced or single side loading conditions.

Sometimes these cantilevered arms are tapered so as to define a full cross section at the base or inner end of the arm with a reducing cross section toward the tip or distal end. Existing arms are fabricated from individual plates which are welded together. The tapered cross-section reduces the weight of the arm even though it remains strong and resistant to flexing as the distance from the standard increase. This tapering can provide easier access as the tip ends define a wider opening for access.

Present arms are fabricated from individual plates which are welded together. This results in a time consuming fabrication operation and can be costly.

It is therefore an object of this invention to provide a less expensive structure and a less time consuming technique for manufacturing tapered cantilevered arms.

Moreover, it is an object of this invention to provide a tapered and cantilevered arm for use with a rack type storage system.

These and other objects of this invention will become apparent from the following description and appended claims.

SUMMARY OF THE INVENTION

This invention relates to an elongated tapered arm to be mounted in an upwardly angled and cantilevered fashion to a vertical standard for storage rack. The arm is an elongated member having a trapezoidal shape and includes a structural member that has a T-shaped cross-section which varies from a maximum size at the base end to a minimum size at the tip end. A bottom plate is secured to the T-shaped structural member along its bottom edge, a mounting plate is secured to the base end and a post-receiving socket to the tip end. The T-shaped structural member is fabricated by providing an elongated I-beam shaped member and cutting its ends at a slight angle (e.g. 4°) but parallel to each other so as to form a parallelogram shape to the I-beam. The web of the I-beam is cut longitudinally from end to end adjacent one acute angle to the other end adjacent the other acute angle on a slight angle of between about 3° and 4°. This provides two tapered and elongated structural members which may be further fabricated into two arms for angled and cantilevered mounting to the vertical standard(s).

This technique reduces the amount of material used and puts the material where it is needed. Moreover the technique results in a cost saving by reducing the material requirements and eliminating the fabricating steps associated with the top of the arm.

BRIEF DESCRIPTION OF THE DRAWINGS

FIG. 1 shows a storage system using angled, tapered and cantilevered arms and carrying a load of lumber.

FIG. 2 is an perspective style view of a single tapered and cantilevered arm mounted to a vertical standard and showing its construction.

FIG. 3 is a side elevational view showing an I-beam cut to form a T-shaped tapered structural member.

FIG. 4 is an exploded and elevational view of a tapered arm showing elements of its construction.

FIG. 5 is a side elevational view of an assembled tapered arm showing its angular positioning relative to a support plate which is secured to a vertical standard.

FIG. 6 is a front end view of a socket system to be mounted at the tip end of the cantilevered arm.

FIG. 7 is a fragmentary and perspective style view of the tip of a tapered arm showing the support socket and in phantom lines a pole mounted thereto.

DESCRIPTION OF THE PREFERRED EMBODIMENT

Referring now to FIG. 1, there is a rack system 10 generally show supporting lengths of lumber such as 12, 14 and 16. The rack system 10 includes four vertical standards, such as 18, each of which are supported by a floor engaging member or foot such as 20 and are interconnected by braces such as the diagonal brace 22. In this system cantilevered and tapered arms, such as 24, 26 and 28 are mounted at a small upward angle to a standard as shown.

Referring now to FIG. 2, a portion of the vertical standard 18 is shown with the center tapered arm 26 shown bolted or otherwise secured to the standard. In this embodiment the arm 26 includes a base plate 28 welded to the arm and secured to the vertical standard. A structural member 30 includes a top surface 32 and integral depending web 34. The arm is elongated and tapers from the base end 35*a* to the tip end 35*b*. The top surface 32 is flat but slightly angled, as suggested by the angle alpha(α) in FIG. 5, relative to the base 28 and in turn the standard 18. A bottom plate 36 is welded to the web 34 and terminates in an upwardly projecting tip or distal end 35*b*. If it is so desired a socket and post supporting clip 38 can also be secured as by bolting to the arm at the tip end. Referring to FIG. 6 the clip 38 includes a plate 40 and has welded thereto a socket assembly which includes a sleeve 42 and an appertured bottom wall 44. A post such as 46 can be fitted into the socket so as to provide an upright at the tip end of the arm. That upright can provide a warning as to the end of the arm or provide a restraint at the end of the arm.

Referring now to FIG. 3, the structural member 30 is fabricated from an I-beam 48 as shown in FIG. 3. The I-beam's ends are cut so as to define a small angle beta (β) which is about 4° and is complementary to the angle alpha (α). The I-beam ends 50 and 52 are parallel to one another. The surfaces 54 and 56 in FIG. 3 are parallel to each other. Thus the ends 50 and 52 and surfaces 54 and 56 form a parallelogram which define a pair of acute angles gamma (γ) and delta (δ). The angle gamma (γ) is formed by the end 50 and surface 56 and delta (δ) by the end 52 and surface 54. Those angles are acute (less than 90°) and are about 86°. In this method of fabrication two structural members such as 30, are formed from a single I-beam. Two structural members are formed by cutting the I-beam web 34 at a small angle theta (θ) which is about 3° relative to its longitudinal axis 59 and from one acute angle such as gamma (γ) to a second acute angle such as delta (δ). The axis of the cut 60 is shown. For dimensional purposes at end 50 the distance from the top surface 54 to the cut 60 is approximately 3¾ inches. The distance from the bottom surface 56 to the cut is approximately 1¼ inches. The same distance is applicable on both ends. The I-beam is approximately 52 inches long, but may be in the range of 48–60 inches.

By cutting the I-beam on a very slight angle theta (θ) relative to its longitudinal axis two tapered structural members, such as 30 are produced.

Referring to FIGS. 4 and 5 the bottom plate 36 is added to the bottom edge of the web 34. The bottom plate is stitch welded to the structural member as at 62, 64 and 66. The socket carrying plate 38 can then be secured to the tip end of the bottom plate.

Thereafter the base plate 28 is welded to the assembly at the base end 35 all around or about the entire profile.

It is appreciated that the tapered sloped cantilevered arm can be secured to the standard and is then in position to carry a load as seen in FIG. 1. If desired, an upright or post such as 46 can be secured to the end of the tapered arm.

It will be appreciated that numerous modifications and changes can be made to the embodiment disclosed herein without departing from the spirit and scope of this invention.

What is claimed is:

1. An elongated tapered arm for mounting to a storage rack vertical standard in a cantilevered fashion, said arm including:

an elongated, integral and T-shaped structural member having an upper surface and a web-like lower member integral with the upper surface which varies in height from a maximum at a base end to a minimum at a tip end, has substantially parallel ends that are angularly oriented relative to the length of the arm and has the general shape of an elongated trapezoid and an elongated bottom plate secured to the web-like lower member along its edge opposite the upper surface between the base end and the tip end, said arm adapted to be mounted to the vertical standard at the base end where the height is at a maximum.

2. An elongated tapered arm as in claim 1 which includes a base plate adapted to join the base end of the structural member and adapted to be secured to the vertical standard.

3. An elongated arm for mounting to a storage rack vertical standard in a cantilevered fashion, said arm including an elongated, integral and T-shaped member having an upper surface, a web-like lower member joined to the upper surface which varies in height from a maximum at a base end to a minimum at a tip end, has substantially parallel ends and has the general shape of an elongated trapezoid, said arm adapted to be mounted to the vertical standard at the base end where the height is the maximum and which includes a tip end upright assembly which comprises a mounting plate constructed to be mounted to the arm at the tip end, a post receiving socket secured to the mounting plate having a general vertical orientation and having a closed but apertured lower end.

4. An elongated tapered arm as in claim 1 and in combination therewith a generally vertical standard to which the arm is secured.

5. A method for fabricating a tapered structural member for use in a tapered arm construction for a storage rack including the steps of:

providing an elongated I-beam shaped member which defines an upper surface and a lower surface joined by a web, said upper and lower surfaces being substantially parallel to each other, a longitudinal axis which extends the length of the web portion, a pair of ends generally parallel to each other and at a slight angle relative to the upper and lower surfaces so that the ends and upper and lower surfaces define a parallelogram shape with an acute angle formed at the intersection of an end and the upper surface and at the other end and at the lower surface;

cutting the web portion along a line extending from end to the other end, said line having starting and ending points between the I-beam's longitudinal axis and the upper and lower surface adjacent the acute angle of the parallelogram whereby the two tapered sections are formed from a single I-beam; and thereafter securing an elongated bottom plate to the cut edge of the web.

* * * * *